US006766607B2

(12) United States Patent
Castaldo

(10) Patent No.: US 6,766,607 B2
(45) Date of Patent: Jul. 27, 2004

(54) ARTICULATIVE, SHELL CASING DEFLECTION AND COLLECTION APPARATUS

(76) Inventor: Nicholas Ben Castaldo, 10 Roff Ave., Palisades Park, NJ (US) 07650

( * ) Notice: Subject to any disclaimer, the term of this patent is extended or adjusted under 35 U.S.C. 154(b) by 0 days.

(21) Appl. No.: 10/367,254

(22) Filed: Feb. 13, 2003

(65) Prior Publication Data

US 2003/0221355 A1 Dec. 4, 2003

Related U.S. Application Data

(63) Continuation-in-part of application No. 09/837,703, filed on Apr. 18, 2001, now abandoned.

(51) Int. Cl.[7] ..... F41A 15/00
(52) U.S. Cl. ..... 42/98; 89/33.4
(58) Field of Search ..... 42/98; 89/33.4

(56) References Cited

U.S. PATENT DOCUMENTS 3,658,241 A * 4/1972 Pistocchi ..... 232/1 R
4,296,565 A * 10/1981 Jaffin et al. ..... 42/98
4,363,475 A * 12/1982 McCarty ..... 269/69
5,269,527 A * 12/1993 Noval ..... 473/197
5,811,716 A * 9/1998 Ellzey ..... 89/33.4
6,354,035 B1 * 3/2002 Niebuhr et al. ..... 42/98

FOREIGN PATENT DOCUMENTS

CH 679519 A5 * 12/1992 ..... F41A/9/60

* cited by examiner

*Primary Examiner*—Michael J. Carone
*Assistant Examiner*—M. Thomson
(74) *Attorney, Agent, or Firm*—John D. Gugliotta; P. Jeff Martin

(57) ABSTRACT

An articulative, shell casing deflection and collection apparatus is provided for deflecting and collecting spent shell casings from firearms when shooting at a range. The apparatus clamps to the edge of a shooting table and is adjustable to suit any type firearm. The frame of the invention forms an arch that originates along the edge of the table and extends up and over the firearm, which would typically be supported on a tripod. A metal fabric screen would be supported across the frame in a rectangular format. A collection bin is located along the bottom such that any shell casings would eject from the firearm, hit the screen and be deflected into the collection bin.

8 Claims, 4 Drawing Sheets

ARTICULATIVE, SHELL CASING DEFLECTION AND COLLECTION APPARATUS

RELATED APPLICATIONS

The present invention is a Continuation in Part of Ser. No. 09/837,703, filed on Apr. 18, 2001, now abandoned.

BACKGROUND OF THE INVENTION

1. Field of the Invention

The present invention relates generally to a cartridge collection apparatus and, more particularly, to an articulative, shell casing deflection and collection apparatus.

2. Description of the Related Art

The hobby of target shooting at a gun range is a sport enjoyed by many. It is a hobby where skill is constantly employed and continual practice will continually improve a participant. While guns such as handguns or single shot rifles are commonly used, other firearms such as semiautomatic or fully automatic rifles are also used. While practice will make perfect with these types of firearms as well, long periods of practice present the disadvantage of spewing spent shell casings all over the immediate area. Not only is this dangerous for someone who may happen to be nearby or at the next shooting station, it also makes a mess to clean up from the floor after practice.

Accordingly, there exists a need for a means by which spent shell casings ejected from a firearm can be deflected or caught in a manner that is quick, easy, and efficient. The development of the articulative, shell casing deflection and collection apparatus fulfills this need.

A search of the prior art did not disclose any patents that read directly on the claims of the instant invention; however, the following references were considered related. The following patents disclose a cartridge casing collector for a firearm: U.S. Pat. No. 5,651,208 issued in the name of Benson; U.S. Pat. No. 5,398,439 issued in the name of Harless; U.S. Pat. No. 4,903,426 issued in the name of Bammate; U.S. Pat. No. 4,028,834 issued in the name of Dobson; U.S. Pat. No. 3,739,685 issued in the name of Lundgren; and U.S. Pat. No. 1,201,189 issued in the name of Johnson.

U.S. Pat. No. 6,009,790 issued in the name of Tekorius describes a wall-mounted bulletproof shield for stopping a bullet accidentally discharged from a firearm.

U.S. Pat. No. 4,821,620 issued in the name of Cartee et al. describes a bullet trap with an anti-splatter safety screen.

U.S. Pat. No. 4,716,809 issued in the name of A'Costa discloses a debris shield/flash reducer for the end of a firearm barrel.

U.S. Pat. No. 3,999,318 issued in the name of Tellie describes firearms involving two ejection outlets for empty cases.

Consequently, a need has been felt for a device which provides an easy and effective means to collect spent shell casings which not only is safer at a shooting range for other participants, but makes cleanup easier as well.

SUMMARY OF THE INVENTION

Therefore, it is an object of the present invention to provide a shell casing deflection screen which deflects and/or catches spent shell casings ejected from firearms.

It is another object of the present invention to provide a shell casing deflection screen which is suitable for use with all types of firearms including automatic and semiautomatic weapons.

It is still another object of the present invention to provide an adjustable frame which adjusts to suit the type of firearm or shooter's preference with respect to being right-handed or left handed.

It is still another object of the present invention to provide an adjustable frame which extends up and over a firearm.

It is another object of the present invention to provide an adjustable frame which provides complete coverage of the firearm.

It is another object of the present invention to provide a lightweight mesh screen but which is strong enough to catch fast moving or hot shell casings.

It is another object of the present invention to provide a mesh screen which can be viewed through for increase safety.

It is another object of the present invention to provide a clamp mechanism which is easily installed and removed.

It is another object of the present invention to provide a clamp mechanism which is adjustable for any type table and which will not damage the table.

It is another object of the present invention to provide a clamp mechanism which can be permanently fastened with screws in lieu of the clamp.

It is another object of the present invention to provide a collection bin located along a lower edge of the screen.

It is another object of the present invention to provide a collection bin for making cleanup easy.

It is another object of the present invention to provide a collection bin which is large enough to hold a generous quantity of shells.

Briefly described according to one embodiment of the present invention, an articulative, shell casing deflection and collection apparatus is provided for deflecting and collecting spent shell casings from firearms when shooting at a range. The invention clamps to the edge of a shooting table and is adjustable to suit any type firearm. The frame of the invention forms an arch that originates along the edge of the table and extends up and over the firearm, which would typically be supported on a tripod. A metal fabric screen would be supported across the frame in a rectangular format. A collection bin is located along the bottom such that any shell casings would eject from the firearm, hit the screen and be deflected into the collection bin.

The use of the present invention provides an easy and effective means to collect spent shell casings which not only is safer at a shooting range for other participants, but makes cleanup easier as well.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
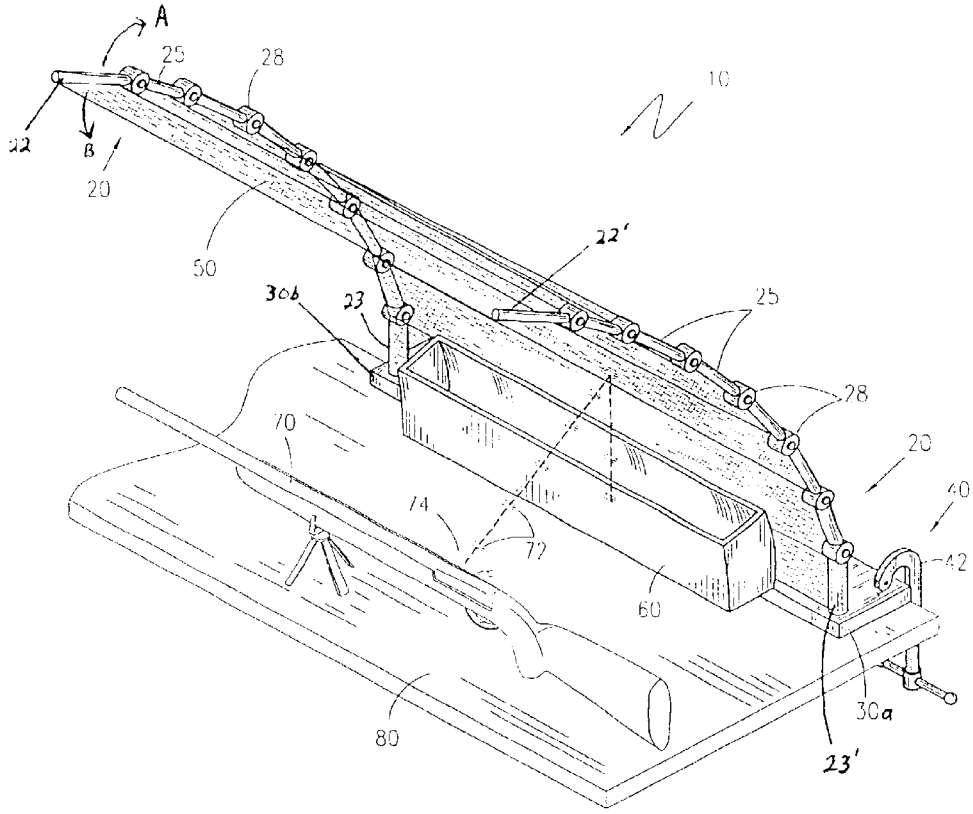
FIG. 1 is a perspective view of an articulative, shell casing deflection and collection apparatus according to the preferred embodiment of the present invention.
Figure 2:
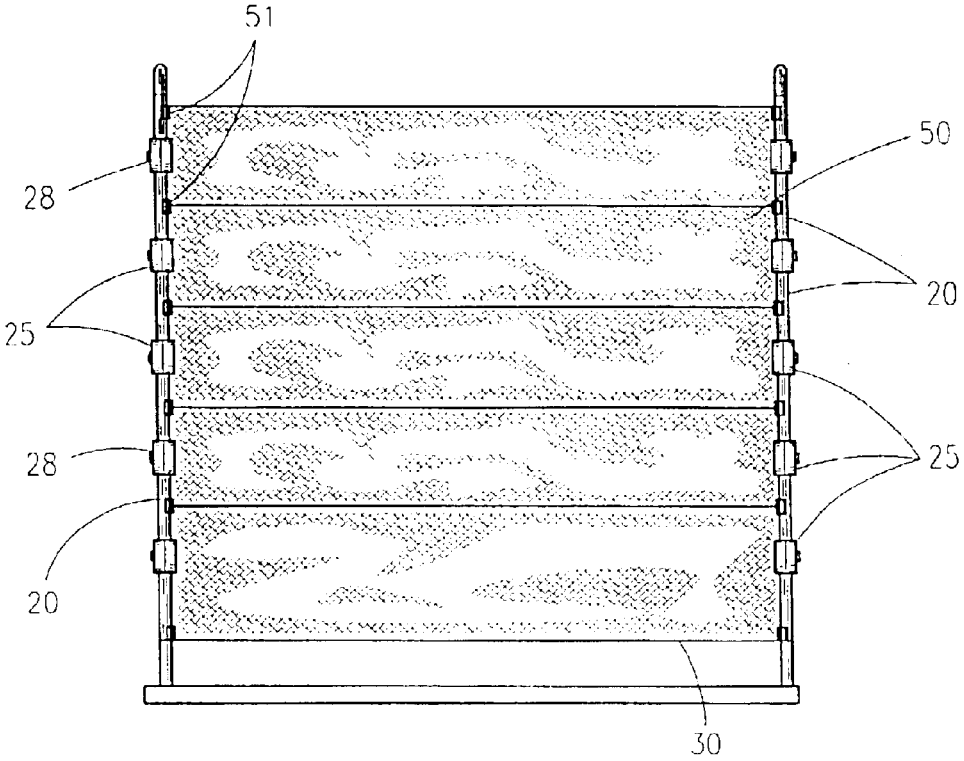
FIG. 2 is a front perspective view of the arms, deflection screen and base plate shown in an upright position according to the preferred embodiment of the present invention.
Figure 3:
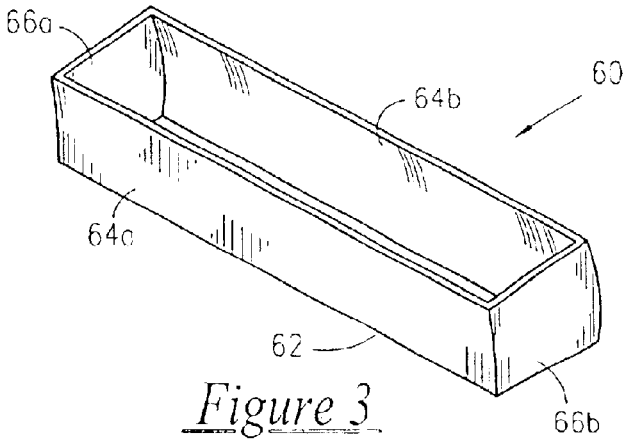
FIG. 3 is a perspective view of the shell casing collection bin according to the preferred embodiment of the present invention.
Figure 4:
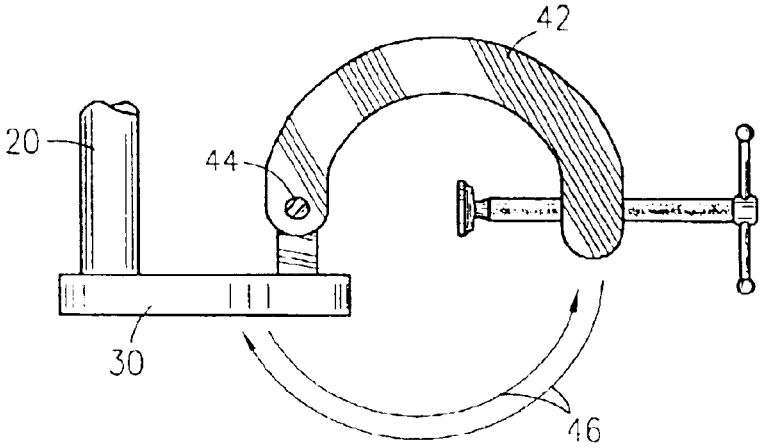
FIG. 4 is a side elevational view of the C-clamp shown pivotally attached to the base plate according to the preferred embodiment of the present invention.
Figure 5:
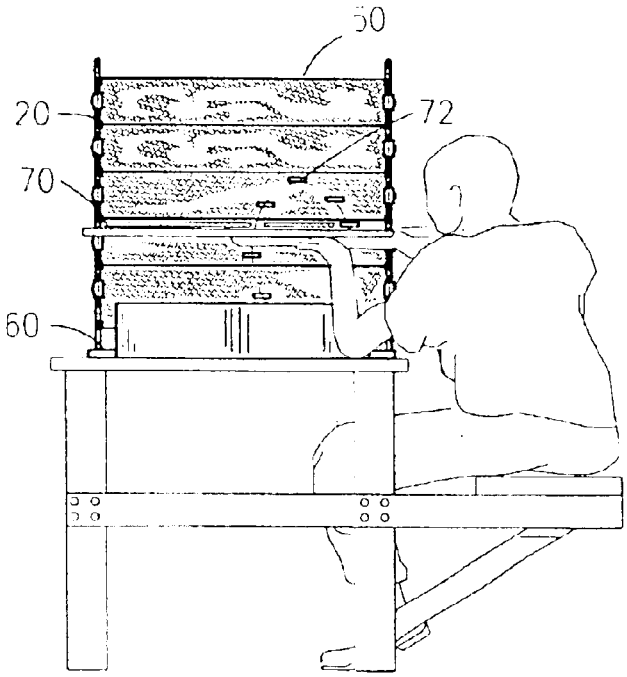
FIG. 5 is a perspective view of the present invention according to the preferred embodiment shown in-use.

Referring now to FIGS. 1–5, an articulative, shell casing deflection and collection apparatus 10 is shown, according to the present invention, comprising of a pair of linearly elongated cylindrical aluminum arms 20, a base plate 30, a first attachment means 40, a shell casing deflection screen 50, a second attachment means 51, and a shell casing collection bin 60.

For purposes of this disclosure, the use of the term "spent casings" is used to refer to a bullet shell casing that has been ejected from a firearm.

Each of the pair of arms 20 is defined as having an anterior end 22 or 22' opposite a posterior end 23 or 23', and is constructed of strong, yet lightweight aluminum. The posterior end 23 of each arm 20 is welded perpendicularly to a respective corner 30*a* and 30*b* of the base plate 30, thus forming two upright arms 20. The base plate 30 is of a flat, rectangular configuration, constructed preferably of steel, and has a length which measures approximately eighteen (18) inches.

Each arm 20 is comprised of a plurality of linearly elongated, cylindrical members 25, wherein the members 25 are collectively united by articulatively bendable joints 28 at lower ends thereof so as to facilitate the formation of an arcuate shape. The articulatively bendable joints 28 are articulating points which pivot about a point 24, thereby providing the cylindrical members 25 with means for pivoting along the directional line A-B and B-A. The articulatively bendable joints 28 of the cylindrical members 25 further allow the arms 20 to extend upward and outward thus forming the arcuate shape which originates at the base plate 30 and extends up and over a firearm 70.

A shell casing deflection screen 50 is supportedly attached by a second attachment means 51, such as a clamp or other similar item, longitudinally clamped on cylindrical members 25 of the arms 20 so as to form a shell casing deflection screen 50 having an overall rectangular shape, viewing the overall rectangular shape along the lines of reference numerals 22 to 22', then 22' to 23', then 23' to 23 and 23 to 22. The deflection screen 50 may also be bolted or mounted to the arms 20 by other suitable means as is widely known in the art. The deflection screen 50 is fabricated of a lightweight, flexible, meshed textile of a strength and gauge suitable for absorbing and deflecting spent casings 72 ejected from a firearm 70. The deflection screen 50 in effect absorbs the kinetic energy of the spent casing 72 so as to prevent the spent casing 72 from being ejected back towards a user of the present invention. In this manner, kinetic energy of a spent casing 72 is removed and forces of gravity then direct the spent casing 72 to drop within the shell casing collection bin 60. The arms 20 and the deflection screen 50 are designed and configured to provide complete coverage of the shell-discharging side of the firearm 70 once the arms 20 and screen 50 are extended up and over the firearm 70. The deflection screen 50 thus further serves to prevent one in close proximity to the shooting area from being struck and injured by an ejected casing.

The shell casing collection bin 60 is constructed of aluminum material and comprises a bottom 62, two opposing sidewalls 64*a*, 64*b*, and two opposing endwalls 66*a*, 66*b*. It is envisioned that the collection bin 60 may be fabricated of other materials such as steel, plastic, and cardboard. Thus, the construction material disclosed for fabricating the shell casing collection bin 60 according to the preferred embodiment is meant merely as a suggestion, and is in no way limiting.

The collection bin 60 is welded to an external circumferential surface of a lower portion of each arm 20, opposite the base plate 30, to the sidewall 64*b* of the collection bin 60. The collection bin 60 may also be bolted or clamped to each arm 20; however, welding is the preferred method for permanent attachment. As bolts require holes, this method of attachment will leave surfaces exposed thereby being more susceptible to rust. The length of the collection bin 60 measures approximately a linear distance separating each arm 20.

The present invention is designed and configured to be removably attached via an attachment means 40, such as a C-clamp 42 placed along the linear length of the base plate 30, to an edge of a shooting table 80. The C-clamp 42 is pivotally attached via a pivot pin 44 to an upper surface of the base plate 30 so as to facilitate swiveling action of the C-clamp 42. The C-clamp 42 is designed to travel in an arch-shaped path, as depicted by a pair of direction arrows 46. The C-clamp 42 is used to clamp the base plate 30 flat against an upper surface of the shooting table 80 near an edge thereof. The pair of arms 20 and deflection screen 50 are extended up and over a firearm 70 thus forming an arcuate shape thereover. The user is careful to attach the present invention to the shooting table 80 such that a casing ejection outlet 74 of the firearm 70 faces the deflection screen 50, as shown in FIG. 1. It is envisioned that in the alternative, the base plate 30 may be permanently mounted to the upper surface of the shooting table 80 near an edge thereof by bolts.

As the user fires the firearm 70, spent casings 72 are ejected from the firearm's 70 casing ejection outlet 74 into the deflection screen 50 and are then directed downward to be collected within the shell casing collection bin 60. The shell casing collection bin 60 serves to make cleanup of spent casings 72 much easier.

Once the user has completed a session of target practice, he simply bends the arms 20 with attached deflection screen 50 to an upright position, loosens and removes the C-clamp 42, and removes the articulative, shell casing deflection and collection apparatus 10 from the shooting table 80.

Figure 6:
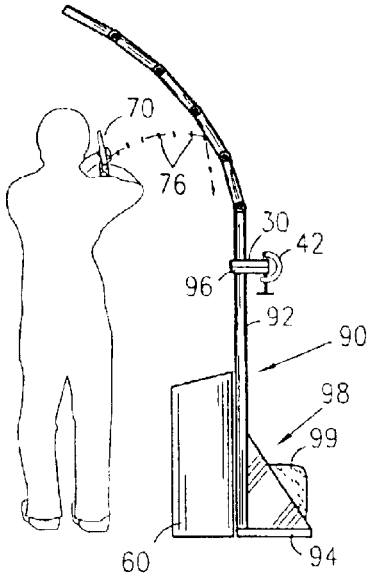
FIG. 6 is a perspective view according to a first alternate embodiment of the present invention shown in-use.

Referring now to FIG. 6, a first alternate embodiment of the present invention is shown, wherein a base apparatus 90 is comprised of a pair of linearly elongated legs 92 with a rectangular plate 94 welded perpendicularly to lower ends therebetween. A base plate supporting platform 96 is welded perpendicularly between upper ends of the legs 92, and is positioned parallel with respect to the rectangular plate 94. A lower surface of the base plate 30 is clamped via the C-clamp 42 to an upper surface of the base plate supporting platform 96. As shown in FIG. 6, such design facilitates deflecting and collecting spent shell casings 76 from firearms 70 while the user shoots from a standing position.

The rectangular plate 94 provides a surface area upon which a weighted object 98 such as a sandbag 99 is supported, thus the weighted object 98 serves as an anchoring means for supporting the legs 92 of the base apparatus 90 in an upright manner.

Figure 7:
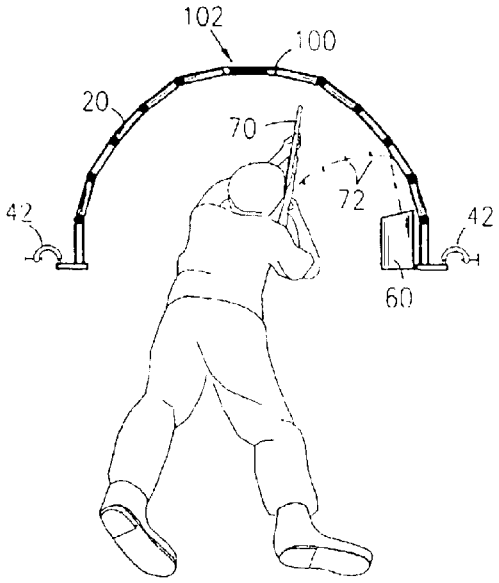
FIG. 7 is a perspective view according to a second alternate embodiment of the present invention shown in-use.

Referring now to FIG. 7, a second alternate embodiment of the present invention is shown, wherein a pair of articulative, shell casing deflecting and collection apparatuses 10 are designed and configured so as to be removably attached via a latch 100, thus forming a domed configuration underwhich a shooter fires a firearm 70 while in a lying position.

Mounted to an upper end of an arm 20, the latch 100 serves to removably attach arms 20 of a pair of articulative, shell casing deflecting and collection apparatuses 10 in a face-to-face manner, such that the shell casing deflection screen 50 from each apparatus 10 combine to form a dome-like structure 102.

The C-clamp 42 of each apparatus is swiveled to a horizontal position with respect to the ground, and a weight measure of each C-clamp 42 serves to anchor the second alternate embodiment of the present invention in a stationary position.

2. Operation of the Preferred Embodiment

To use the present invention, the user places a firearm on the shooting table. Next, the user clamps the base plate of the present invention flat against an upper surface of the shooting table near an edge thereof with a C-clamp. The pair of arms and deflection screen are extended up and over the firearm thus forming an arcuate shape thereover. The user is careful to attach the present invention to the shooting table such that a casing ejection outlet of the firearm faces the deflection screen. As the user fires the firearm, spent casings are ejected from the firearm's casing ejection outlet into the deflection screen and are then directed downward to be collected within the shell casing collection bin. The shell casing collection bin serves to make cleanup of spent casings much easier.

Once the user has completed a session of target practice, the user simply bends the arms with attached deflection screen to an upright position, loosens and removes the C-clamp, and removes the articulative, shell casing deflection and collection apparatus from the shooting table.

The use of the present invention provides an easy and effective means to collect spent shell casings which not only is safer at a shooting range for other participants, but makes cleanup easier as well.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be broadly limited only by the following claims.

What is claimed is:

1. A shell casing deflection and collection apparatus comprising:

a base plate of a flat, rectangular configuration;

a pair of linearly elongated cylindrical aluminum arms, each of said pair of arms having an anterior end opposite a posterior end, wherein said posterior end of said arm is attached perpendicularly to a respective corner of said base plate, thus forming two upright arms;

wherein each of said pair of arms comprises a plurality of linearly elongated, cylindrical members wherein said cylindrical members are collectively united by articulatively bendable joints at lower ends thereof so as to facilitate the formation of an arcuate shape, wherein said articulatively bendable joints are articulating points wherein each of said articulatively bendable joints pivot about a point which provides said cylindrical members with means for pivoting, and wherein said articulatively bendable joints of said cylindrical members further allowing said arms to extend upward and outward forming an arcuate shape which originate at said base plate and extends up and over a firearm;

a shell casing deflection screen attached to said pair of arms;

a first attachment means for attaching said screen and said base plate to an edge of a shooting table;

a second attachment means for attaching said screen to said arms; and a shell casing collection bin.

2. The shell casing deflection and collection apparatus of claim 1, wherein said second attachment means comprises clamps longitudinally clamped on said cylindrical members of said arms so as to form a rectangularly shaped enclosure.

3. The shell casing deflection and collection apparatus of claim 1, wherein said deflection screen is fabricated of a lightweight, flexible, meshed textile of a strength and gauge suitable for absorbing and deflecting spent casings ejected from said firearm.

4. The shell deflection and collection apparatus of claim 3, wherein said arms and said deflection screen are designed and configured to provide complete coverage of the shell-discharging side of the said firearm once said arms and said screen are extended up and over said firearm.

5. The shell deflection and collection apparatus of claim 1, wherein said shell casing collection bin comprises a bottom, two opposing sidewalls and two opposing endwalls, and is constructed of material selected from the group comprising aluminum, steel, plastic, and cardboard.

6. The shell casing deflection and collection apparatus of claim 5, wherein said shell casing collection bin is attached to an external circumferential surface of a lower portion of each said arm, opposite said base plate, to said sidewall of said collection bin.

7. The shell deflection and collection apparatus of claim 1, wherein said first attachment means comprises a C-clamp pivotally attached via a pivot pin to an upper surface of said base plate so as to facilitate swiveling action of said C-clamp, said C-clamp adapted to travel in an arch-shaped path.

8. The shell casing deflection and collection apparatus of claim 1, wherein each of said articulatively bendable joints of said cylindrical members pivot about said point of each of said articulatively bendable joints so as to facilitate vertical extension of said arms to an upright position.

* * * * *